US008069905B2

(12) United States Patent
Goto

(10) Patent No.: US 8,069,905 B2
(45) Date of Patent: Dec. 6, 2011

(54) EGR GAS COOLING DEVICE

(75) Inventor: Tadahiro Goto, Fuji (JP)

(73) Assignee: Usui Kokusai Sangyo Kaisha Limited (JP)

( * ) Notice: Subject to any disclaimer, the term of this patent is extended or adjusted under 35 U.S.C. 154(b) by 281 days.

(21) Appl. No.: 10/864,846

(22) Filed: Jun. 9, 2004

(65) Prior Publication Data

US 2005/0098307 A1 May 12, 2005

(30) Foreign Application Priority Data

Nov. 6, 2003 (JP) ..... 2003-166560

(51) Int. Cl.
*F28F 9/22* (2006.01)
*F28D 7/16* (2006.01)

(52) U.S. Cl. ..... 165/41; 165/51; 165/145; 165/157

(58) Field of Classification Search ..... 165/145, 165/157, 159, 41, 51
See application file for complete search history.

(56) References Cited

U.S. PATENT DOCUMENTS

| | | | | | |
|---|---|---|---|---|---|
| 1,358,947 | A * | 11/1920 | Fulton | 237/9 A |
| 2,214,057 | A * | 9/1940 | Hull | 165/152 |
| 2,750,159 | A * | 6/1956 | Ebner | 165/145 |
| 3,147,800 | A * | 9/1964 | Tadewald | 165/152 |
| 3,407,874 | A * | 10/1968 | Gier, Jr. | 165/152 |
| 3,483,920 | A * | 12/1969 | Heyn et. al. | 165/157 |
| 4,276,929 | A * | 7/1981 | Howard | 165/145 |
| 4,441,549 | A * | 4/1984 | Vasiliev et al. | 165/145 |
| 4,593,755 | A * | 6/1986 | Rogers, Jr. | 165/145 |
| 4,667,734 | A * | 5/1987 | Langle | 165/145 |
| 4,966,230 | A * | 10/1990 | Hughes et al. | 165/152 |
| 6,247,523 | B1 * | 6/2001 | Shibagaki et al. | 165/153 |
| 6,301,925 | B1 * | 10/2001 | Funaba et al. | 62/497 |
| 2002/0074105 | A1 * | 6/2002 | Hayashi et al. | 165/43 |
| 2003/0089491 | A1 | 5/2003 | Mitsumoto et al. | |
| 2004/0177949 | A1 * | 9/2004 | Shimoya et al. | 165/152 |

FOREIGN PATENT DOCUMENTS

| | | | | |
|---|---|---|---|---|
| JP | 58055684 | A * | 4/1983 | 165/157 |
| JP | 05079791 | A * | 3/1993 | |
| JP | 06094389 | A * | 4/1994 | |
| JP | 07-167585 | | 7/1995 | |
| JP | 09-310991 | | 2/1997 | |
| JP | 09-310996 | | 2/1997 | |
| JP | 09-088730 | | 3/1997 | |

(Continued)

OTHER PUBLICATIONS

Non-patent publication—Principle and Design of Heat Exchangers.

*Primary Examiner* — Leonard Leo
(74) *Attorney, Agent, or Firm* — Gerald E. Hespos; Michael J. Porco

(57) ABSTRACT

A gas cooling device capable of efficiently cooling a gas such as an EGR gas, etc. is provided. A multiplicity of cooling pipes perpendicularly intersecting a gas flow direction in a gas pipe for a gas such as an EGR gas, etc. are provided to extend through an outer peripheral wall of the gas pipe, a cooling jacket is provided on an outer surface of the gas pipe on both sides of a group of the cooling medium pipes in an axial direction, or on the entire outer surface of the gas pipe, and the gas in the gas pipe is cooled by a cooling medium flowing through the cooling pipes.

13 Claims, 12 Drawing Sheets

FOREIGN PATENT DOCUMENTS

| | | | |
|---|---|---|---|
| JP | 09-088731 | | 3/1997 |
| JP | 10-227591 | | 8/1998 |
| JP | 10-306995 | | 11/1998 |
| JP | 10-339598 | | 12/1998 |
| JP | 11-023181 | | 1/1999 |
| JP | 11-108578 | | 4/1999 |
| JP | 11280564 A | * | 10/1999 |
| JP | 2000-054916 | | 2/2000 |
| JP | 2000-111277 | | 4/2000 |
| JP | 2000-234566 | | 8/2000 |
| JP | 2000-240514 | | 9/2000 |
| JP | 2001-041680 | | 2/2001 |
| JP | 2001-141386 | | 5/2001 |
| JP | 2001-193576 | | 7/2001 |
| JP | 2001-207919 | | 8/2001 |
| JP | 2002-350071 | | 4/2002 |
| JP | 2003-021478 | | 1/2003 |

* cited by examiner

EGR GAS COOLING DEVICE

TECHNICAL FIELD

The present invention relates to a gas cooling device, and more particularly, to a device that cools an EGR gas in an EGR gas pipe at the time of exhaust gas recirculation (referred below to as EGR), in which a part of exhaust gases is taken out from an exhaust system of a diesel engine and returned to an intake system through the EGR gas pipe to be added to a mixture.

BACKGROUND ART

A method of taking out a part of exhaust gases from an exhaust system to return the same to an intake system of an engine again to add the same to a mixture is called EGR (Exhaust Gas Recirculation). EGR is thought to be a method that is effective in purification of exhaust gases of an engine and enhancement in thermal efficiency because it produces much effect such as suppression of generation of NOx (nitrogen oxide) reduction in pumping loss, that reduction in radiation loss to a cooling liquid, which is accompanied by temperature drop of combustion gases, an increase in specific heat ratio, which is caused by changes in quantity and composition of working gas, and enhancement in cycle efficiency accompanying such increase.

However, when an EGR gas is increased in temperature and in quantity, an EGR valve is degraded in durability due to a thermal influence thereof and suffers in some cases from early breakage, and it is recognized that there is a need for a water-cooled construction for the purpose of prevention such degradation and breakage and fuel consumption is decreased due to that reduction in charging efficiency, which is caused by an increase in intake-air temperature. In order to avoid such situation, there is used a device that cools an EGR gas with a cooling liquid of an engine, a cooling medium for car air conditioners, a cooling wind, or the like.

Various coolers of heat exchanger type have been proposed as a conventional cooling device for an EGR gas.

There are, for example, a double tube type heat exchanger, in which an outer tube for having a liquid passing therethrough is arranged outside an inner tube for having a gas passing therethrough, heat exchange is performed between the gas and the liquid, and metallic corrugated sheets are inserted as fins into the inner tube (see JP-A-11-23181), a double tube type heat exchanger, in which an inner tube and an outer tube are provided, and either of a high-temperature side fluid passage and a low-temperature side fluid passage is provided on a side of the inner tube and a side of the outer tube, respectively (see JP-A-2002-350071), a double tube type heat exchanger comprising an inner tube for having a medium being cooled, flowing inside, an outer tube provided in a manner to surround an outer periphery of the inner tube with a gap therebetween, and radiating fins having a thermal stress relaxing function and arranged inside the inner tube (see JP-A-2000-111277), a double tube type heat exchanger comprising an inner tube for having a medium being cooled, flowing inside, an outer tube provided in a manner to surround an outer periphery of the inner tube with a gap therebetween, and cross fins arranged inside the inner tube (see JP-A-2003-21478), an EGR gas cooling device, in which a cooling pipe (heat transfer pipe) is brought into contact with and spirally wound around an outer peripheral surface of an EGR gas pipe (see JP-A-9-88730), and an EGR gas cooling device constructed such that a cooling pipe (heat transfer pipe) extends through an outer peripheral wall of an EGR gas pipe to be inserted into the EGR gas pipe (see JP-A-9-88731).

DISCLOSURE OF INVENTION

With the conventional double tube type heat exchangers disclosed in JP-A-11-23181, JP-A-2002-350071, JP-A-2000-111277, and JP-A-2003-21478, however, the pipe that defines an EGR gas flow passage has a smooth, inner peripheral surface over an entire length in a lengthwise direction in many cases, and so there is caused a problem that heat transfer is not adequate in the vicinity of a center of the pipe to lead to a low cooling efficiency of the EGR gas.

Also, with the EGR gas cooling devices disclosed in JP-A-9-88730 and JP-A-9-88731, there is an advantage that manufacture is easy and cost is low but because of a small heat transfer area, there is a need of specifically increasing an axial length in order to ensure a heat transfer capacity, so that the cooling devices occupy a large space to be problematic in layout when mounted on an automobile, and there is further caused a problem that since a gas flows along the EGR gas pipe, turbulence is generated to a less extent in the gas flow, so that the boundary layer on the heat transfer surface is not made adequately thin and the heat transfer capacity is somewhat poor.

The invention has been thought of in order to solve the above problems in conventional gas cooling measures, and has its object to provide a gas cooling device that enhances a heat exchanging capacity by means of a multiplicity of cooling pipes perpendicularly intersecting a gas flow direction in a gas flow passage.

The invention provides a gas cooling device characterized in that a multiplicity of cooling pipes (heat transfer pipes) perpendicularly intersecting a gas flow direction in a gas pipe are fixedly arranged on the gas pipe to extend through an outer peripheral wall of the gas pipe with both pipe ends of the respective cooling pipes opened to an outside, a cooling jacket having an inflow port and an outflow port for a cooling medium is fixed to an outer surface of the gas pipe on both sides of a group of the cooling medium pipes in an axial direction, or to the entire outer surface of the gas pipe, and a gas in the gas pipe is cooled by the cooling medium flowing through the cooling pipes.

Also, according to the invention, the cooling pipes comprise spiral-shaped fins or disk-shaped fins on outer peripheries thereof, at least one plate fin in parallel to a gas flow in the gas pipe and perpendicular to the cooling pipes is provided in the gas pipe, on which the cooling pipes are fixedly arranged, in a heat exchange region, a burring wall is provided on a through-hole of the plate fin, into which the cooling pipe is inserted, and the plate fin is provided with at least one of louvers, through-holes, pin fins, and irregularities.

BEST MODE FOR CARRYING OUT INVENTION

Figure 1:
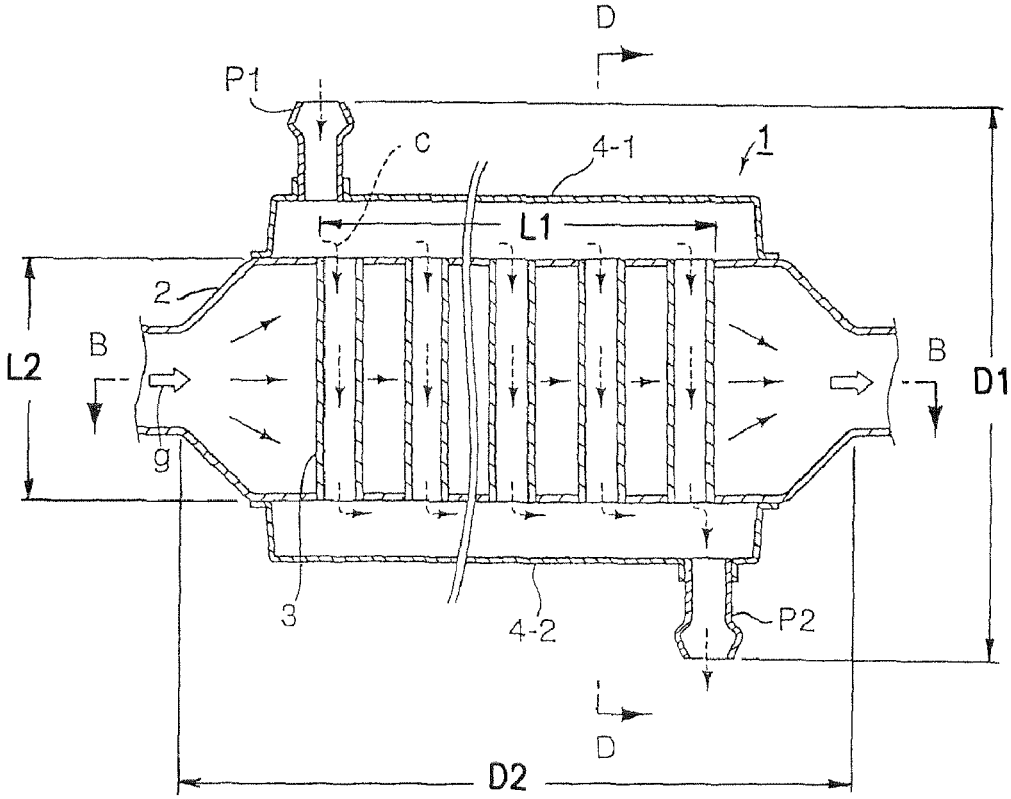
FIG. 1 is a longitudinal, cross sectional, side view showing a device according to a first embodiment of the invention with a part thereof omitted.
Figure 2:
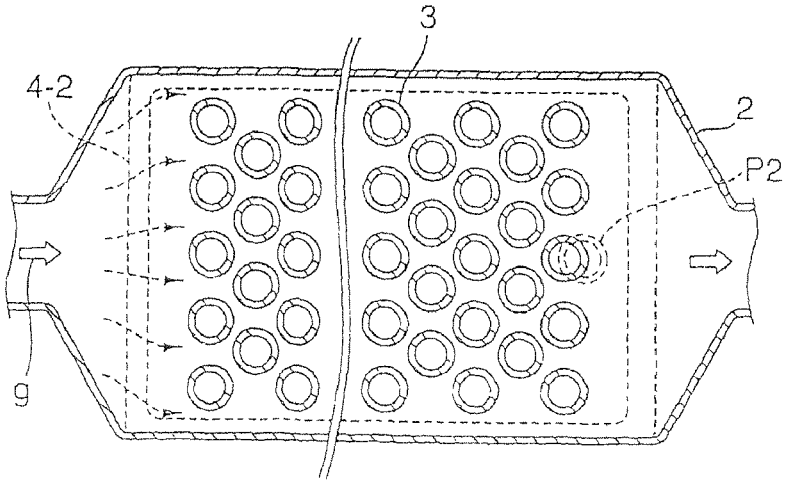
FIG. 2 is a transverse, cross sectional plan view taken along the line B-B in FIG. 1.
Figure 3:
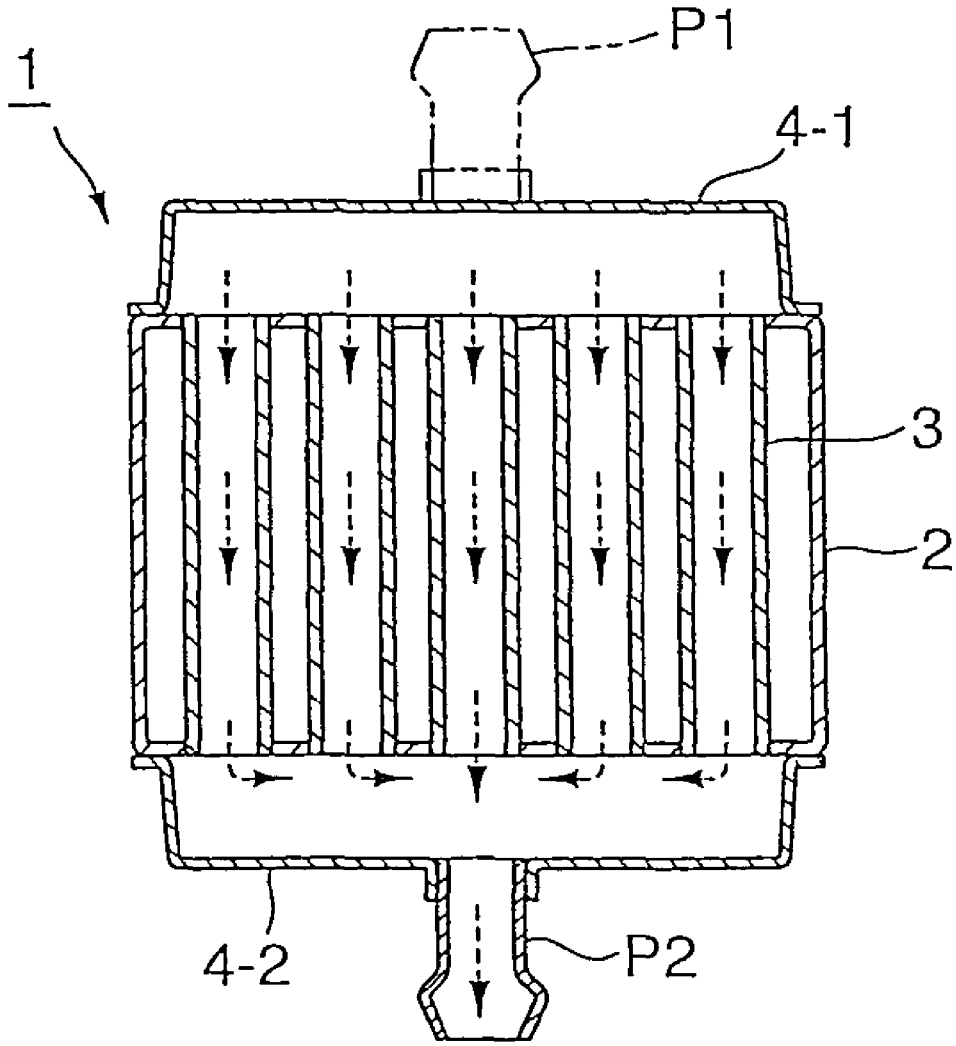
FIG. 3 is a longitudinal, cross sectional, front view taken along the line D-D in FIG. 1.

In the invention, first, an EGR gas cooling device 1 shown in FIGS. 1, 2, and 3 comprises a multiplicity of cooling pipes (heat-transfer pipes) 3 perpendicularly intersecting a gas flow direction (an arrow g) of an EGR gas flowing in an EGR gas pipe 2, which is enlarged in diameter and has a rectangular-shaped cross section, the cooling pipes being fixedly arranged at a predetermined spacing on the EGR gas pipe to extend through an outer peripheral wall of the EGR gas pipe with both pipe ends of the respective cooling pipes opened to an outside. Further, cooling jackets 4-1, 4-2 are fixed to an outer surface of the EGR gas pipe on both sides in an axial direction of the cooling pipes. The cooling jackets 4-1, 4-2, respectively, are provided with an inflow port P1 and an outflow port P2 of a cooling medium.

With the EGR gas cooling device 1 constructed in the above manner, the EGR gas flowing in a direction of an arrow g within the EGR gas pipe 2 is cooled by the cooling medium that flows in a direction of an arrow c within the respective cooling pipes 3 from one 4-1 of the cooling jackets. At this time, the EGR gas flowing in the EGR gas pipe 2 is made turbulent in gas flow by the multiplicity of cooling pipes 3 arranged perpendicular to the gas flow, so that it quickly performs heat exchange with the cooling medium that flows in the multiplicity of cooling pipes 3 in a direction (a direction indicated by an arrow c) perpendicular to the flow of the ERG gas. As shown in FIG. 1, the group of cooling water pipes 3 is disposed along a section of the EGR gas pipe having a length L1 in the axial direction that exceeds the length L2 of each of the cooling water pipes. Additionally, the inflow port P1 has an inlet end spaced out from the cooling jacket and the outflow port P2 has an outlet end spaced from the cooling jacket. The inlet end of the inflow port P1 is offset from the outlet end of the outflow port P2 by a distance D1, as shown in FIG. 1, that is less than a length D2 of the EGR gas pipe from the inlet to the outlet thereof.

Figure 4:
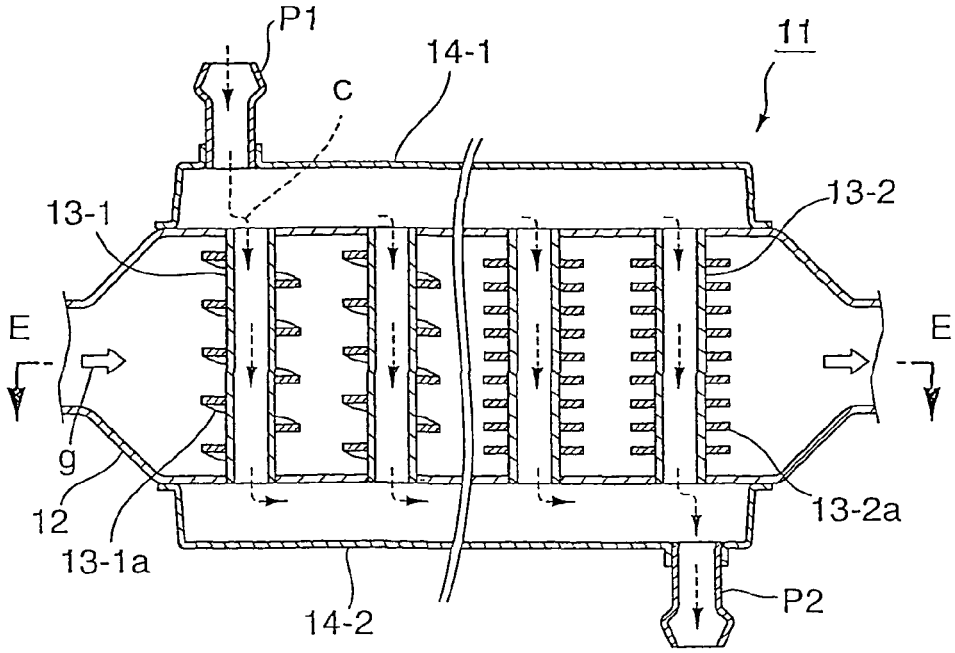
FIG. 4 is a longitudinal, cross sectional side view showing a device according to a second embodiment of the invention with a part thereof omitted.
Figure 5:
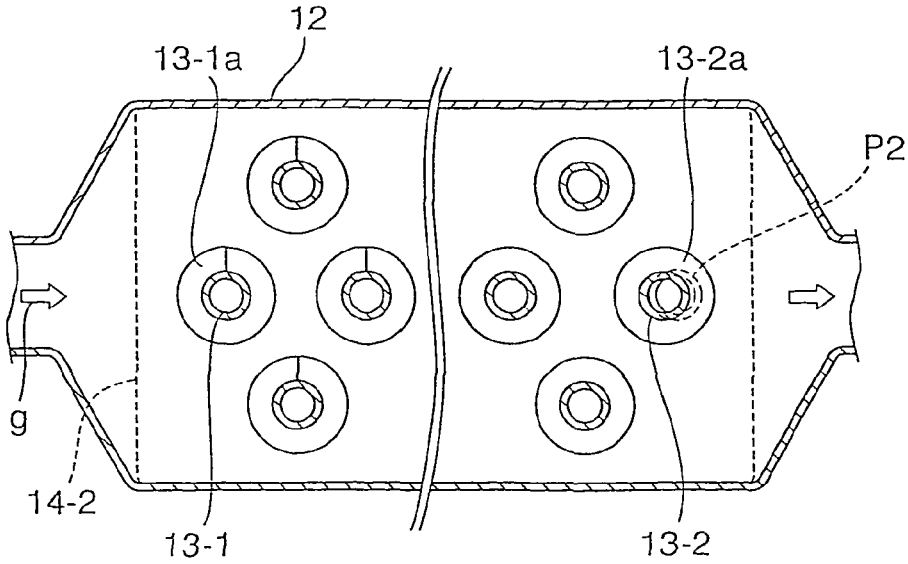
FIG. 5 is a transverse, cross sectional plan view taken along the line E-E in FIG. 4.

An EGR gas cooling device 11 shown in FIGS. 4 and 5 is the same in construction as the cooling device shown in FIGS. 1 and 2 except that finned tubes 13-1, 13-2 are used for cooling pipes. More specifically, a multiplicity of finned tubes 13-1, 13-2 perpendicularly intersecting a gas flow direction (an arrow g) of an EGR gas flowing in an EGR gas pipe 12, which is enlarged in diameter and has a rectangular-shaped cross section, are fixedly arranged at a predetermined spacing on the gas pipe to extend through an outer peripheral wall of the EGR gas pipe with both pipe ends of the respective cooling pipes opened to an outside, and cooling jackets 14-1, 14-2 are fixed to an outer surface of the EGR gas pipe on both sides of the cooling pipes in an axial direction. Here, the finned tubes 13-1 are provided on outer peripheral surfaces of tube bodies with spiral-shaped fins 13-1*a*, and the finned tubes 13-2 are provided on outer peripheral surfaces of tube bodies with disk-shaped fins 13-2*a*.

In addition, while a combined configuration of the finned tubes 13-1 with the spiral-shaped fins and the finned tubes 13-2 with the disk-shaped fins is shown here, it goes without saying that finned tubes with various fins, in which wavy-shaped fins, pin-shaped fins, etc. are used as well as spiral-shaped fins and disk-shaped fins, maybe combined together, and a whole configuration may be composed of only one type of tubes, for example, only the spiral-shaped fins 13-1, or only the disk-shaped fins 13-2.

Also, with the EGR gas cooling device 11 shown in FIGS. 4 and 5, the EGR gas flowing in the direction of the arrow g within the EGR gas pipe 12 is cooled by the cooling medium that flows in a direction of an arrow c within the respective finned tubes 13-1, 13-2 from one 14-1 of the cooling jackets in the same manner as in the device shown in FIGS. 1 and 2. At this time, not only the EGR gas flowing in the EGR gas pipe 12 is made turbulent in gas flow by the finned tubes 13-1, 13-2 arranged perpendicular to the gas flow, but also an agitating action caused by the spiral-shaped fins 13-la and the disk-shaped fins 13-2*a* is added to quickly achieve heat transfer, so that a high heat exchanging capacity is obtained due to an increase in heat transfer area of the fins.

Figure 6:
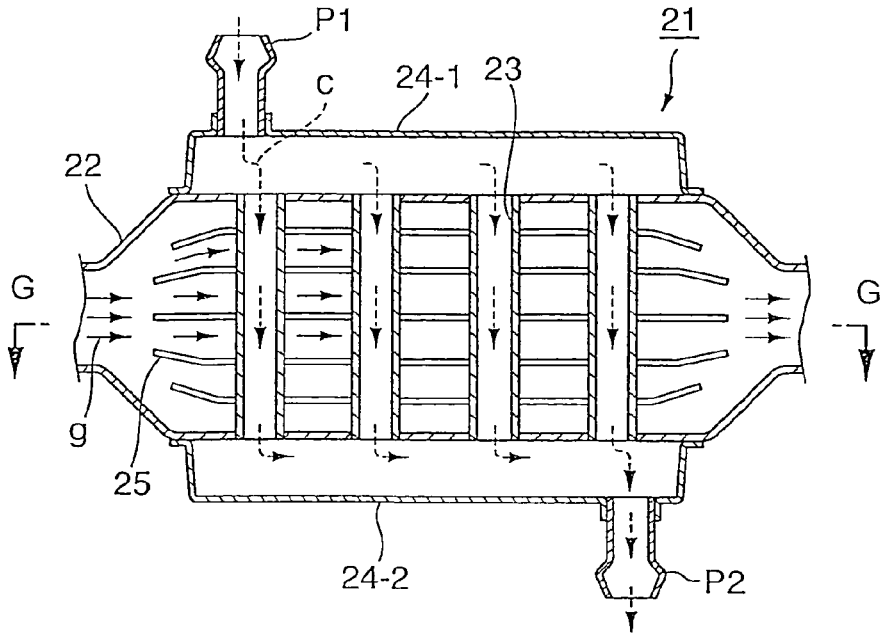
FIG. 6 is a longitudinal, cross sectional side view showing a device according to a third embodiment of the invention with a part thereof omitted.
Figure 7:
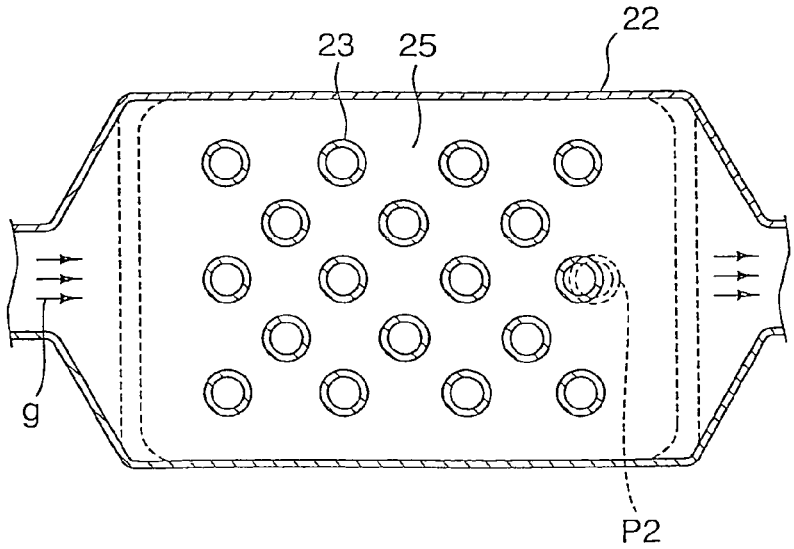
FIG. 7 is a transverse, cross sectional plan view taken along the line G-G in FIG. 6.

An EGR gas cooling device 21 shown in FIGS. 6 and 7 is the same in construction as the EGR gas cooling device 1 shown in FIGS. 1 and 2 except that provided in an EGR gas pipe 22 in a heat-exchange region, on which a group of cooling pipes are fixed and arranged, are plate fins 25, which are in parallel to a gas flow in the EGR gas pipe and perpendicular to the cooling pipes. More specifically, a multiplicity of cooling pipes 23 perpendicularly intersecting a gas flow direction (an arrow g) of an EGR gas flowing in an EGR gas pipe 22, which is enlarged in diameter and has a rectangular-shaped cross section, are fixedly arranged at a predetermined spacing on the EGR gas pipe to extend through an outer peripheral wall of the EGR gas pipe with both pipe ends of the respective cooling pipes opened to an outside, the plate fins 25 in parallel to a gas flow (the arrow g) in the gas pipe and perpendicular to the cooling pipes 23 are arranged five at constant intervals within the EGR gas pipe 22, in which the multiplicity of cooling pipes 23 are arranged, and cooling jackets 24-1, 24-2 are fixed to an outer surface of the EGR gas pipe on both sides of the cooling pipes thereof in an axial direction.

Also, with the EGR gas cooling device 21 shown in FIGS. 6 and 7, the EGR gas flowing in the direction of the arrow g within the EGR gas pipe 22 is cooled by the cooling medium that flows in a direction of an arrow c within the respective cooling pipes 23 from one 24-1 of the cooling jackets in the same manner as in the device shown in FIGS. 1 and 2. At this time, not only the EGR gas flowing in the EGR gas pipe 22 is made turbulent in gas flow by the multiplicity of cooling pipes 23, which are arranged to perpendicularly intersect the gas flow, but also a heat transfer area is increased by the plate fins 25 in parallel to a gas flow (the arrow g) in the gas pipe and perpendicular to the cooling pipes 23, so that heat transfer is quickly achieved and a high heat exchanging capacity is obtained in this case.

Figure 8:
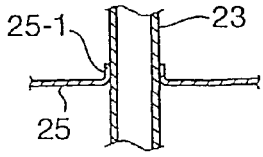
FIG. 8 is a cross sectional view showing an example of a construction, in which a cooling pipe (heat transfer pipe) and a plate fin are joined together in the device, according to the third embodiment, shown in FIGS. 6 and 7.
Figure 9:
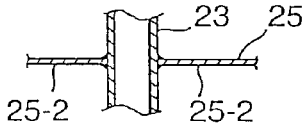
FIG. 9 is a cross sectional view showing an example of a plate fin provided with a through-hole, in the device, according to the third embodiment, shown in FIG. 6.
Figure 10A:
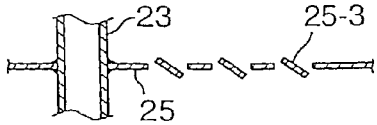
FIGS. 10A and 10B are cross sectional view showing two examples of a plate fin provided with louvers, in the device.
Figure 10B:
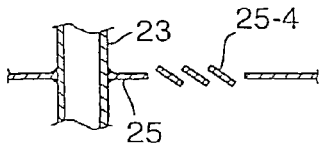
Figure 11:
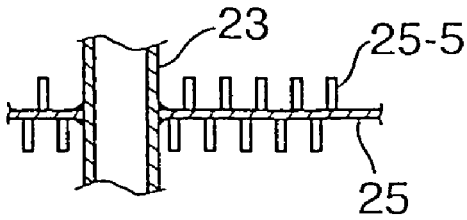
FIG. 11 is a cross sectional view showing an example of a plate fin provided with pin fins, in the device.
Figure 12:
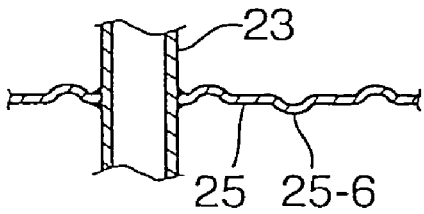
FIG. 12 is a cross sectional view showing an example of a plate fin provided with irregularities that are formed by press forming.

Also, in a construction of joining the cooling pipes 23 and the plate fins 25 together in the EGR gas cooling device 21 shown in FIGS. 6 and 7, in which the plate fins 25 are built, burring walls 25-1 are provided, as shown in FIG. 8, on through-holes of the plate fins 25, into which the cooling pipes 23 are inserted, in order to increase a contact area between the plate fins and the cooling pipes.

Further, in order to increase turbulence and an agitating action in the EGR gas flowing in the EGR gas pipe 22, the plate fins 25 may be provided, as shown in, for example, FIGS. 9 to 12, with a multiplicity of through-holes 25-2 (FIG. 9), louvers 25-3 (FIG. 10A), 25-4 (FIG. 10B), pin fins 25-5 (FIG. 11), or irregularities 25-6 (FIG. 12) formed by press forming. In addition, the irregularities 25-6 shown in FIG. 12 maybe either circular-shaped or stripe-shaped.

Figure 13:
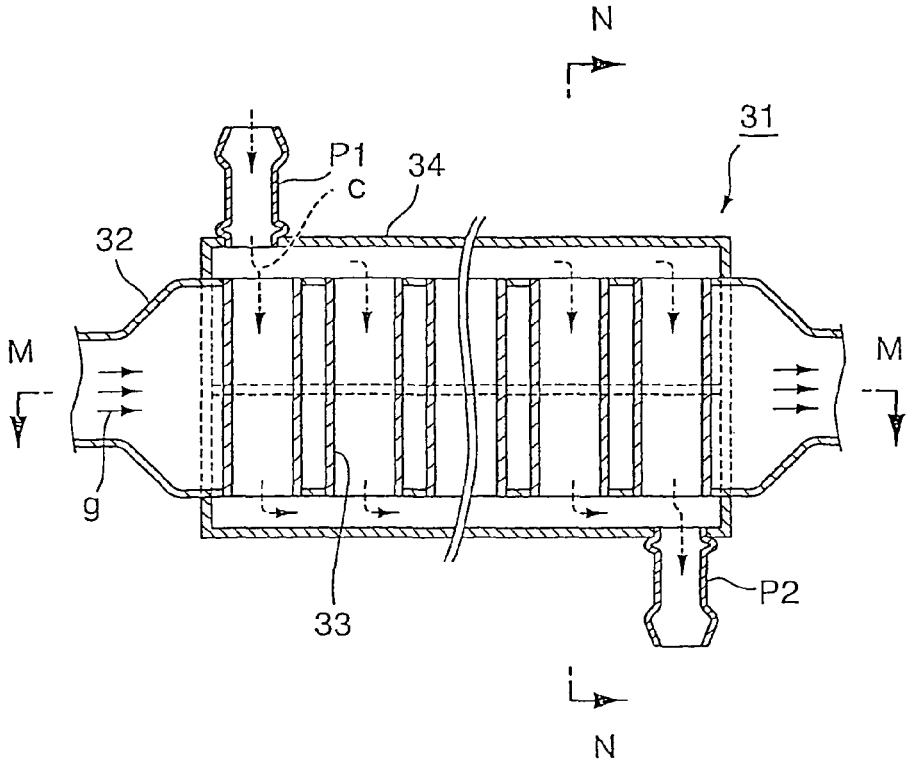
FIG. 13 is a longitudinal, cross sectional side view showing a device according to a fourth embodiment of the invention with a part thereof omitted.
Figure 14:
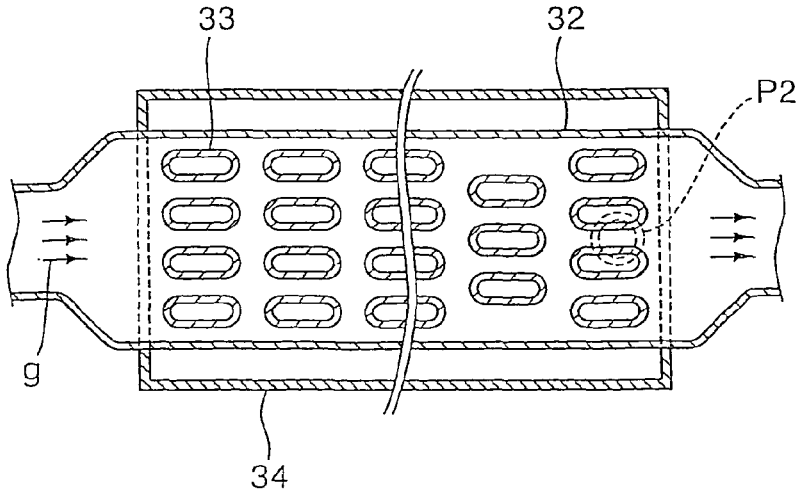
FIG. 14 is a transverse, cross sectional plan view taken along the line M-M in FIG. 13.
Figure 15:
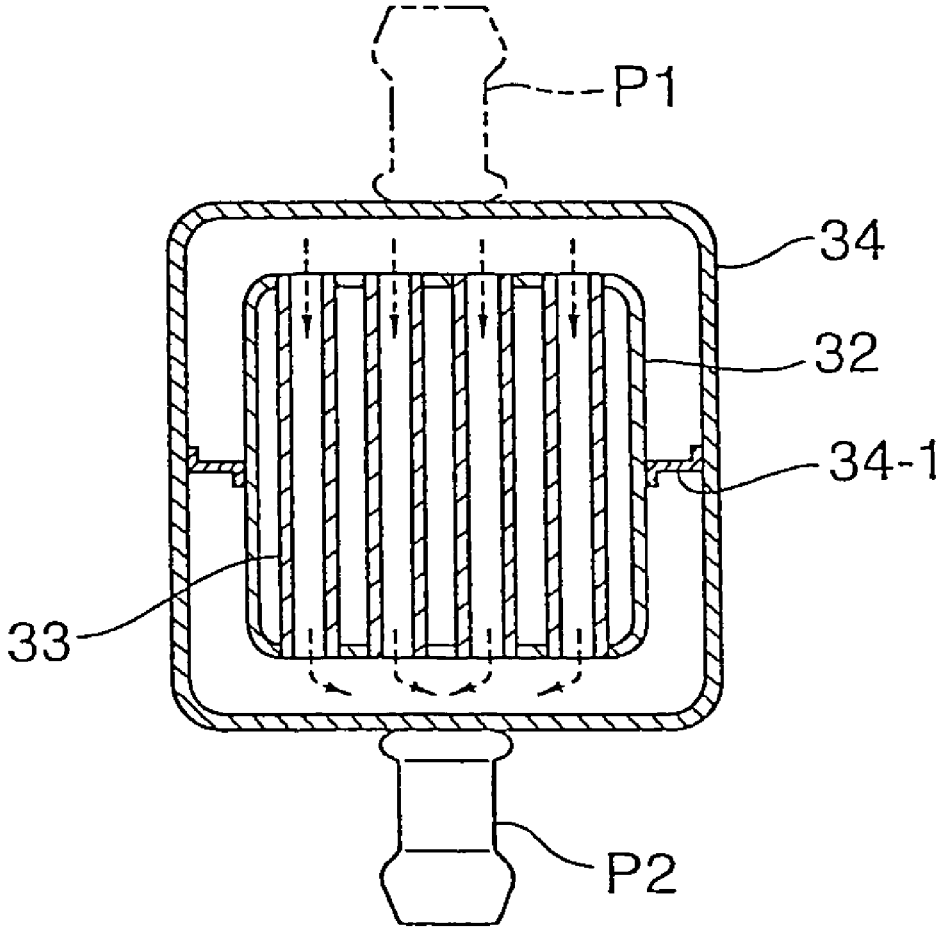
FIG. 15 is a longitudinal, cross sectional front view taken along the line N-N in FIG. 13.

An EGR gas cooling device 31 shown in FIGS. 13, 14 and 15 is of a so-called double tube type such that a multiplicity of flat tubes 33 perpendicularly intersecting a gas flow direction (an arrow g) of an EGR gas flowing in an EGR gas pipe 32, which is enlarged in diameter and has a rectangular-shaped cross section, are fixedly arranged at a predetermined spacing on the EGR gas pipe to extend through an outer peripheral wall of the EGR gas pipe with both tube ends of the respective flat tubes 33 opened to an outside, in the same manner as the arrangement described above, and a cooling jacket 34, an interior of which is divided into two upper and lower sections by a separator 34-1, is fixed to an entire outer periphery of the EGR gas pipe 32.

With the EGR gas cooling device 31 of a double tube type shown in FIGS. 13, 14 and 15, the EGR gas flowing in the direction of the arrow g within the EGR gas pipe 32 is cooled by a cooling medium that flows in a direction of an arrow c within the respective flat tubes 33 from the cooling jacket 34 that is provided in a manner to surround the EGR gas pipe 32. Also, with the EGR gas cooling device 31 of a double tube type, the EGR gas flowing in the EGR gas pipe 32 is made turbulent in gas flow by the flat tubes 33, which are arranged to perpendicularly intersect the gas flow, so that it quickly performs heat exchange with the cooling medium that flows in the multiplicity of flat tubes 33 in a direction (a direction indicated by the arrow c) perpendicular to the flow of the EGR gas.

In addition, while the flat tubes 33 in the device according to this embodiment are arranged differently between inlet and outlet sides of the EGR gas pipe 32, an arrangement of the flat tubes 33 is not limited to such arrangement but it goes without saying that the arrangement of the flat tubes 33 on either of the inlet side or the outlet side may be applied to the entire EGR gas pipe 32.

Figure 16:
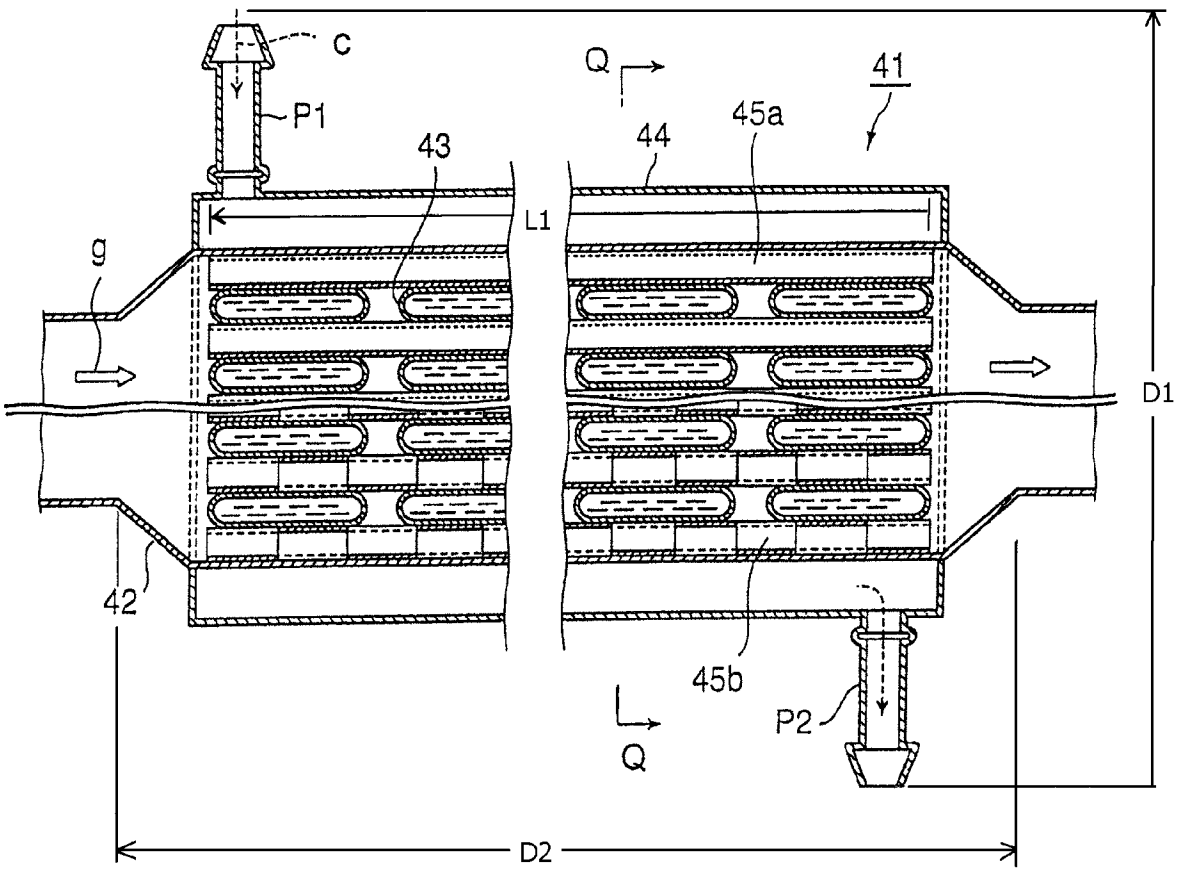
FIG. 16 is a longitudinal, cross sectional side view showing a device according to a fifth embodiment of the invention with a part thereof omitted.
Figure 17:
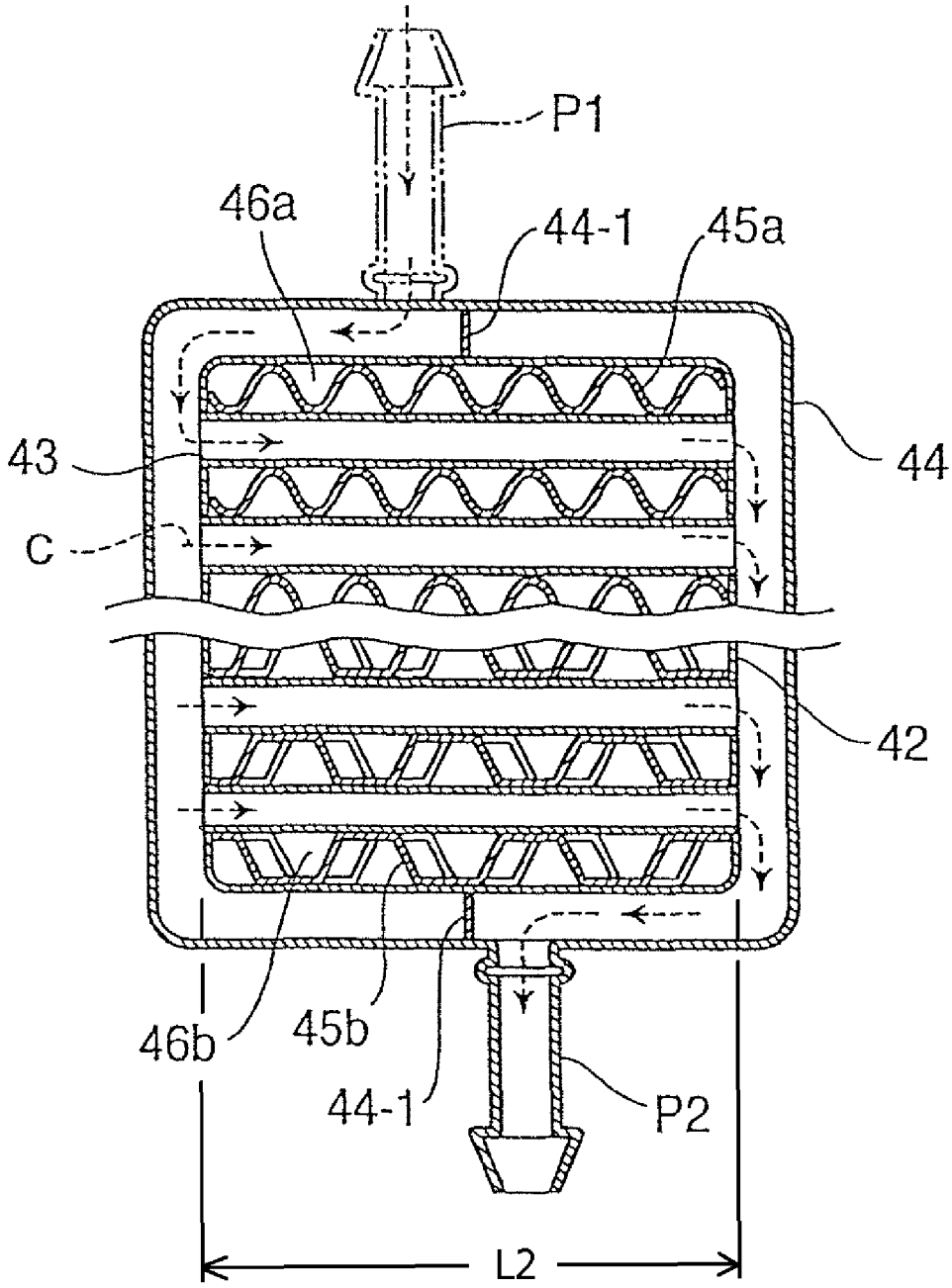
FIG. 17 is a transverse, cross sectional plan view taken along the line Q-Q in FIG. 16.

An EGR gas cooling device 41 shown in FIGS. 16, 17, and 18 is constructed such that a multiplicity of flat tubes 43 perpendicularly intersecting a gas flow direction (an arrow g) of an EGR gas flowing in an EGR gas pipe 42, which is enlarged in diameter and has a rectangular-shaped cross section, are aligned in multi-stages and in parallel to one another with a spacing therebetween to extend horizontally through side walls of the EGR gas pipe with both tube ends of the respective flat tubes 43 opened to an outside, two types of corrugated sheets 45*a*, 45*b* shown, in enlarged scale, in FIG. 18 are interposed in several stages between the respective flat tubes 43 to extend in a longitudinal direction of the EGR gas pipe 42, thus defining flow passages 46*a*, 46*b*, and a cooling jacket 44, an interior of which is compartmented into right and left sections by a separator 44-1, is fixed to an entire outer periphery of the EGR gas pipe 42, and a type of the device is a double tube type in the same manner as the arrangement described above. As shown in FIGS. 16 and 17, the group of cooling water pipes 43 is disposed along a section of the EGR gas pipe having a length L1 in the axial direction that exceeds the length L2 of each of the cooling water pipes. Additionally, the inflow port P1 has an inlet end spaced out from the cooling jacket and the outflow port P2 has an outlet end spaced from the cooling jacket. The inlet end of the inflow port P1 is offset from the outlet end of the outflow port P2 by a distance D1, as shown in FIGS. 16 and 17, that is less than a length D2 of the EGR gas pipe from the inlet to the outlet thereof.

Figure 18A:
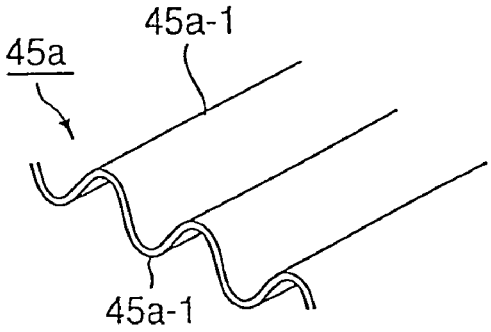
FIG. 18A and 18B are fragmentary, perspective views showing, in enlarged scale, a corrugated sheet part in the device according to the fifth embodiment of the invention, FIG. 18A showing one of the corrugated sheets, and FIG. 18B showing the other of the corrugated sheets.
Figure 18B:
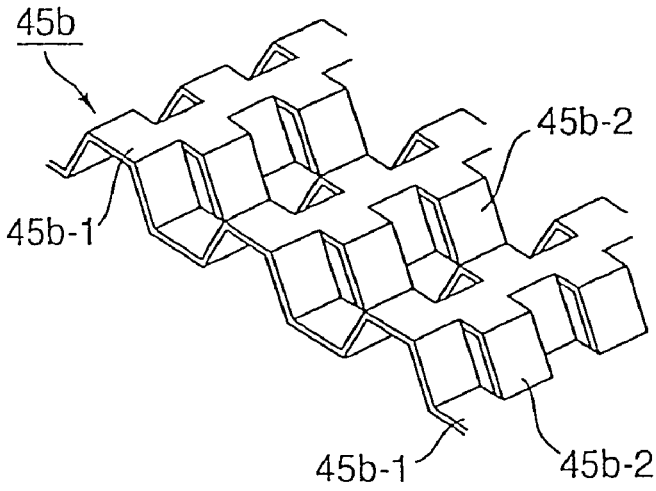

In addition, one 45*a* out of the two types of corrugated sheets 45*a*, 45*b* has rounded tops 45*a*-1 as shown in FIG. 18A. The other 45*b* of the corrugated sheets has flat tops 45*b*-1 as shown in FIG. 18B, and flat surfaces between the tops define irregular-shaped barriers 45*b*-2 to generate turbulence or vortices in the gas flow passing through the EGR gas pipe 42 and to produce an edge effect, thus enabling enhancing the heat exchanging efficiency of the EGR gas further. Also, while there is shown an example, in which the corrugated sheets 45*a* are arranged in an upper portion of the EGR gas pipe 42 and the corrugated sheets 45*b* are arranged in a lower portion of the EGR gas pipe in the EGR gas cooling device 41 shown in FIGS. 16, 17, and 18, it goes without saying that the corrugated sheets 45*b* may be arranged in the upper portion and the corrugated sheets 45*a* may be arranged in the lower portion in contrast with the above, or the entire EGR gas pipe 42 may be composed of either of the corrugated sheets.

With the EGR gas cooling device 41 of a double tube type constructed as shown in FIGS. 16, 17, and 18, the EGR gas flowing in the direction of the arrow g within the EGR gas pipe 42 is cooled by a cooling medium that flows in a direction of an arrow c within the respective flat tubes 43 from the cooling jacket 44 that is provided in a manner to surround the EGR gas pipe 42. With the EGR gas cooling device 41 of a double tube type, the EGR gas flowing in the EGR gas pipe 42 generates turbulence or vortices while flowing in the flow passages 46*a*, 46*b* formed by the two types of corrugated sheets 45*a*, 45*b*, so that it quickly performs heat exchange with the cooling medium that flows in the multiplicity of flat tubes 43 in a direction (a direction indicated by the arrow c) perpendicular to the flow of the EGR gas, and thus a further high heat exchanging capacity is obtained.

Figure 19:
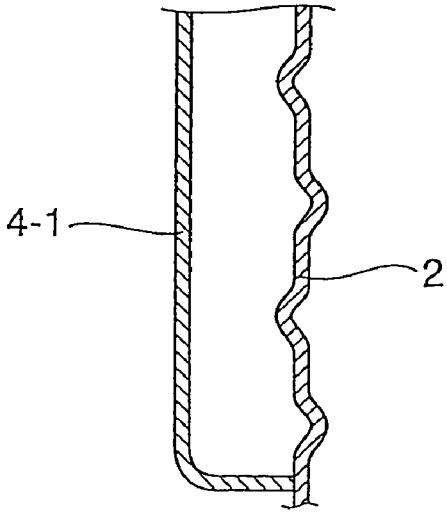
FIG. 19 is a fragmentary, cross sectional view showing an example of a cross sectional structure of a wall surface of the EGR gas pipe according to the invention.
Figure 20:
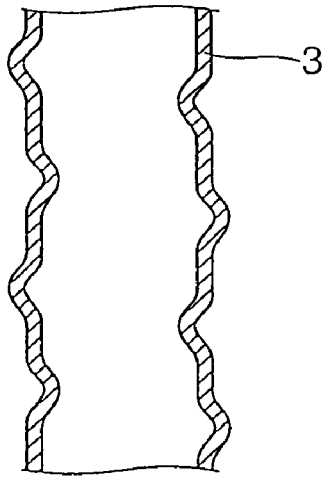
FIG. 20 is a fragmentary, cross sectional view showing an example of a cross sectional structure of a wall surface of the heat transfer pipe according to the invention.

In addition, the cooling pipes 3, 23, the finned tubes 13-1, 13-2, and the flat tubes 33, 43 in the EGR gas cooling device according to the invention are not specifically limitative in arrangement, number, thickness, etc. but such arrangement, number, thickness, etc. are appropriately determined according to-magnitudes of the EGR gas pipe 2, 12, 22, 32, 42 and a scale of the cooling device, or the like. Also, the EGR gas pipe 2, 12, 22, 32, 42, the cooling pipes 3, 23, the finned tubes 13-1, 13-2, and the flat tubes 33, 43 in the invention may be formed on wall surfaces thereof with irregularities to produce an increase in turbulence and heat transfer area, as shown in FIGS. 19 and 20, respectively.

Also, while circular pipes having a cross section of perfect circle and flat tubes are illustrated to exemplify the cooling pipes, they are not limitative and it goes without saying that circular pipes having an elliptical cross section, pipes having a rectangular or polygonal cross section, etc. are usable. Also, welding, brazing, etc. can be used as measures for adherence and fixation of the respective parts.

In addition, while a gas cooling device such as EGR coolers, etc. has been described, it goes without saying that it can be also used as a gas heating device.

INDUSTRIAL APPLICABILITY

As described above, the EGR gas cooling device according to the invention produces an excellent effect that owing to those cooling pipes, which comprises a multiplicity of straight pipes and finned tubes arranged to perpendicularly intersect an EGR gas flowing in an EGR gas pipe, and an action of the cooling pipes and fin plates, turbulence in gas flow and an increase in heat transfer area are achieved to provide a high heat exchanging capacity.

The invention claimed is:

1. An EGR gas cooling device comprising: an EGR gas pipe having an inlet, an outlet spaced downstream from the inlet along an axial direction and an outer peripherial wall extending from the inlet to the outlet, the outer peripheral wall being of substantially rectangular cross-section and including first and second opposed wall sections aligned substantially parallel to the axial direction, a multiplicity of flat cooling water pipes with two opposed flat wall sections aligned parallel to the axial direction of the EGR gas pipe joined by two opposed curved wall sections, the cooling water pipes perpendicularly intersecting an EGR gas flow direction in the EGR gas pipe and fixedly arranged in the EGR gas pipe to extend only in a single direction through the first and second wall sections of the outer peripheral wall of the EGR gas pipe with opposite inlet and outlet ends of the respective cooling water pipes opened to an outside of the EGR gas pipe at the respective first and second wall sections of the EGR gas pipe, all of the cooling water pipes being substantially straight, of equal lengths (L2)and parallel to one another, the EGR cooling device having no cooling water pipes aligned at an angle to the multiplicity of parallel cooling water pipes, a cooling jacket for engine cooling water, the cooling jacket being of substantially rectangular cross-section and being fixed to at least a part of an outer surface of the EGR gas pipe on both sides of a group of the cooling water pipes in the axial direction, and the EGR gas pipe is cooled by the cooling water flowing through the cooling water pipes, the group of cooling water pipes being disposed along a section of the EGR gas pipe having a length (L1) in the axial direction that exceeds the length (L2) of each of the cooling water pipes; the cooling jacket having opposite inflow and outflow walls aligned substantially parallel to the cooling water pipes, an inflow port extending into the cooling jacket at the inflow wall and an outflow port extending out of the cooling jacket at the outflow wall, a first separator extending from the inflow wall of the cooling jacket to the EGR gas pipe at a position in proximity to the inflow port and between the inflow port and the second wall section of the EGR gas pipe for channeling the cooling water only to the inlet ends of the cooling water pipes at the first wall section of the EGR gas pipe and a second separator extending from the outflow wall of the cooling jacket to the EGR gas pipe at a position in proximity to the outflow port and between the outflow port and the first wall section of the EGR gas pipe for channeling the cooling water from the outlet ends of the cooling water pipes at the second wall sections of the EGR gas pipe to the outflow port, the inflow port having an inlet end spaced from the cooling jacket and the outflow port having an outlet end spaced from the cooling jacket, the inlet end of the inflow port being offset from the outlet end of the outflow port in a direction measured perpendicular to both the cooling water pipes and the axial direction of the EGR gas pipe by a distance (D1) that is less than a length (D2) of the EGR gas pipe from the inlet to the outlet thereof.

2. The EGR gas cooling device according to claim 1, further comprising corrugated sheets provided in the EGR gas pipe in a heat-exchange region, on which the cooling water pipes are fixed and arranged, the corrugated sheets having rounded tops, which are in parallel to a gas flow in the EGR gas pipe and perpendicular to the cooling water pipes.

3. The gas cooling device according to claim 1, further comprising corrugated sheets provided in that EGR gas pipe in a heat-exchange region, on which the cooling pipes are fixed and arranged, the corrugated sheets comprising flat tops in parallel to a gas flow is the EGR gas pipe and the flat surfaces between the tops to define irregular-shaped barriers.

4. An EGR gas cooling device comprising:

an EGR gas pipe having an inlet end, an outlet end and peripheral wall extending between the inlet and outlet ends for defining a gas flow direction extending from the inlet end to the outlet end of the EGR gas pipe, the peripheral wall being of substantially rectangular cross-section and having first and second opposed parallel wall sections aligned parallel to the gas flow direction;

a multiplicity of cooling water pipes of equal lengths (L2) and extending only in a single direction, each of said cooling water pipes having a first end defining and inlet and a second end opposite the first end and defining and outlet, the first and second ends being mounted respectively to the first and second wall sections of the peripheral wall of the EGR gas pipe at a spaced apart locations so that each of the cooling water pipes provides communication through the EGR gas pipe between first and second positions external of the EGR gas pipe, all of the cooling water pipes being substantially parallel to one another and extending substantially perpendicular to the gas flow direction defined by the EGR gas pipe, the EGR cooling device having no cooling water pipes aligned at an angle to the mulptiplicity of substantially parallel cooling water pipes, each of the cooling water pipes being defined by two opposed flat wall sections aligned essentially parallel to the gas flow direction of the EGR gas pipe and joined by two opposed curved wall section; and a cooling jacket of substantially rectangular cross-section and being fixed to at least a part of an outer surface of the EGR gas pipe, the cooling jacket having opposite inflow and outflow walls substantially parallel to one another and substantially normal to the first and second wall sections of the EGR pipe, an inflow port extending through the inflow wall of the cooling jacket and into a first portion of the cooling jacket for accommodating an inflow of a cooling medium from the inflow port, through the first portion of the cooling jacket and into the first end of each of the respective cooling water pipes and an outflow port extending through the outflow wall of the cooling jacket and out of a second portion of the cooling jacket for accommodating an outflow of the cooling medium from the second end of each of the cooling water pipes, through the second portion of the cooling jacket and out of the outflow port, a first separator extending from the EGR gas pipe to the inflow wall of the cooling jacket at a position in proximity to the inflow port and between the inflow port and the second wall section of the EGR gas pipe for channeling the cooling medium only to the first ends of the respective cooling water pipes at the first wall section of the EGR gas pipe, a second separator extending from the EGR gas pipe to the outflow wall of the cooling jacket at a position in proximity to the outflow port and between the outflow port and the first wall section of the EGR gas pipe for channeling the cooling medium from the second end of each of the respective cooling water pipes at the second wall section of the EGR gas pipe only to the outflow port, the cooling pipes being disposed along a section of the EGR pipe defining a length(L1) along the gas flow direction that exceeds the length (L2) of each of the cooling water pipes, the inflow port having a inlet end spaced from the cooling jacket and the outflow port having an outlet end spaced from the cooling jacket, the inlet end of the inflow port being offset from the outlet end of the outflow port in a direction measured parallel to the cooling water pipes by a distance (D1) that is less than a length (D2) of the EGR gas pipe from the inlet to the outlet thereof.

5. The EGR gas cooling device according to claim 4, further comprising corrugated sheets provided in a heat-exchange region of the EGR gas pipe, each of the cooling water pipes being fixed adjacent to a least one of the corrugated sheets, each of the corrugated sheets having a plurality of corrugations extending substantially parallel to the gas flow direction on the EGR gas pipe.

6. The EGR gas cooling device of claim 5, wherein each of the cooling water pipes is fixed adjacent to two of the corrugated sheets.

7. The EGR gas cooling device of claim 5, wherein each of the corrugations in at least one of the corrugated sheets has a rounded top.

8. The EGR gas cooling device according to claim 5, further comprising means for isolating the first portion of the cooling jacket from direct communication with second portion of the cooling jacket so that all flow of the cooling medium from the first portion of the cooling jacket to the second portion of the cooling jacket is through the cooling water pipes.

9. The EGR gas cooling device of claim 5, wherein the inflow port and the outflow port are offset from one another in directions perpendicular to the gas flow direction in the EGR gas pipe.

10. The EGR gas cooling device of claim 9, wherein inflow port is in proximity to the inlet end of the EGR gas pipe,and the outflow port is in proximity to the outlet end of the EGR gas pipe.

11. The EGR gas cooling device of claim 4, wherein a distance from the inflow port to the inlet of the EGR gas pipe is less than a distance from the outflow port to the inlet of the EGR gas pipe.

12. The EGR gas cooling device of claim 11, wherein the inflow port and the outflow port each have diameters approximately equal to diameters defined by the respective cooling water pipes.

13. The EGR gas cooling device of claim 12, wherein a sum of the lengths of the inflow port and the outflow port is less than the equal lengths of the respective cooling water pipes.

* * * * *

UNITED STATES PATENT AND TRADEMARK OFFICE

CERTIFICATE OF CORRECTION

PATENT NO. : 8,069,905 B2
APPLICATION NO. : 10/864846
DATED : December 6, 2011
INVENTOR(S) : Tadahiro Goto It is certified that error appears in the above-identified patent and that said Letters Patent is hereby corrected as shown below:

Title Page, Item (30) Foreign Application Priority Data should read

--June 11, 2003 (JP) ..... 2003-166560--

Signed and Sealed this
Twenty-first Day of February, 2012

David J. Kappos

David J. Kappos
*Director of the United States Patent and Trademark Office*